US006942033B2

(12) United States Patent
Brooks et al.

(10) Patent No.: US 6,942,033 B2
(45) Date of Patent: Sep. 13, 2005

(54) OPTIMIZING CHARGE PHASING OF A PERFORATING GUN

(75) Inventors: James E. Brooks, Manvel, TX (US); Jorge Lopez de Cardenas, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 10/325,348

(22) Filed: Dec. 19, 2002

(65) Prior Publication Data

US 2004/0118607 A1 Jun. 24, 2004

(51) Int. Cl.[7] ..... E21B 43/08
(52) U.S. Cl. ..... 166/297; 166/284; 175/4.51
(58) Field of Search ..... 166/284, 305.1, 166/306, 297, 381; 175/4.6, 4.57, 4.56, 4.51

(56) References Cited

U.S. PATENT DOCUMENTS 2,833,213 A * 5/1958 Udry ..... 175/4.6
3,565,188 A * 2/1971 Hakala ..... 175/4.6
3,762,473 A * 10/1973 Wolk ..... 166/241.5
3,964,553 A * 6/1976 Basham et al. ..... 175/4.51
4,193,460 A * 3/1980 Gilbert ..... 175/4.6
4,371,044 A * 2/1983 Willig et al. ..... 175/4.6
4,552,234 A * 11/1985 Revett ..... 175/4.6
2002/0189802 A1 * 12/2002 Tolman et al. ..... 166/55

OTHER PUBLICATIONS

Gatlin, Petroleum Engineering, 1960 Prentice–Hall, Inc.,pp 308–319.*

* cited by examiner

*Primary Examiner*—Frank Tsay
(74) *Attorney, Agent, or Firm*—Trop, Pruner & Nu PC; Jaime A. Castaño; Brigitte Echols

(57) ABSTRACT

A technique that is usable with a subterranean well includes orienting shaped charges of a perforating gun to extend partially around a longitudinal axis of the gun. The perforating gun is oriented in the well to direct the shaped charges away from a water boundary. In response to this orientation of the perforating gun, the shaped charges are fired. The perforating gun and shaped charges may also be oriented in a deviated well to compensate for the anisotropic permeability of a formation.

56 Claims, 11 Drawing Sheets

OPTIMIZING CHARGE PHASING OF A PERFORATING GUN

BACKGROUND

The invention generally relates to optimizing charge phasing of a perforating gun.

For purposes of enhancing the production of well fluid from a subterranean formation, a device called a perforating gun typically is lowered down into the wellbore (that extends into the formation) to form perforation tunnels in the formation. The perforating gun includes radially-oriented shaped charges that are fired to form perforation jets that create these perforation tunnels. Typically, specified parameters called a shot density and a phasing angle control the number of shaped charges of the gun and the distances between the shaped charges. Most perforating gun phasing is spiral, which means that the shaped charges are located along a helical path that circumscribes the longitudinal axis of the perforating gun. In this spiral phasing pattern, adjacent shaped charges typically are spaced equally apart. Phasing patterns other than spiral phasing patterns are also conventionally used. For example, a conventional perforating gun may have a planar phasing pattern in which multiple shaped charges are arranged in planes, and these planes have surface normals that are parallel to the longitudinal axis of the gun.

As a more specific example, FIG. 1 depicts a cross-sectional view of a perforating gun 20 that has shaped charges that are arranged in a spiral phasing pattern. This spiral phasing pattern is shown in FIG. 2, a figure that depicts a schematic view of the perforating gun 20 along its longitudinal axis 21.

More particularly, FIG. 1 shows a top view of three exemplary shaped charges 10*a*, 10*b* and 10*c* of the perforation gun 20. Adjacent shaped charges, such as the shaped charges 10*a* and 10*b* (for example), are spaced 135° apart about the longitudinal axis 21 of the gun 20. Thus, the perforating gun 20 is said to have a 135° spiral phasing pattern. The distances between adjacent charges in this spiral phasing pattern establish the shot density (typically expressed as shots per foot (spf)) of the perforating gun 20. Therefore, for example, a greater shot density may be achieved by decreasing the distances between adjacent shaped charges. As depicted in FIGS. 1 and 2, the shaped charges of the perforating gun 20 extend along a helical path that completely circumscribes the longitudinal axis 21 of the gun 20.

SUMMARY

In an embodiment of the invention, a technique that is usable with a subterranean well includes orienting shaped charges of a perforating gun to extend partially around a longitudinal axis of the gun. The perforating gun is oriented in the well to direct the shaped charges away from a water boundary. In response to this orientation of the perforating gun, the shaped charges are fired. The perforating gun and shaped charges may also be oriented in a deviated well to compensate for the anisotropic permeability of a formation.

Advantages and other features of the invention will become apparent from the following description, drawing and claims.

BRIEF DESCRIPTION OF THE DRAWING

FIG. 12 depicts a flattened view of a casing string wall after firing of the shaped charges of the perforating system of FIG. 11.

DETAILED DESCRIPTION

Figure 1:
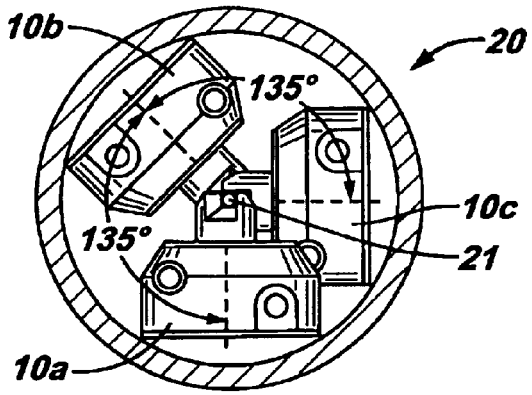
FIG. 1 (Prior Art)
FIG. 1 depicts a cross-sectional view of a perforating gun of the prior art illustrating a top view of exemplary shaped charges of the gun.
Figure 2:
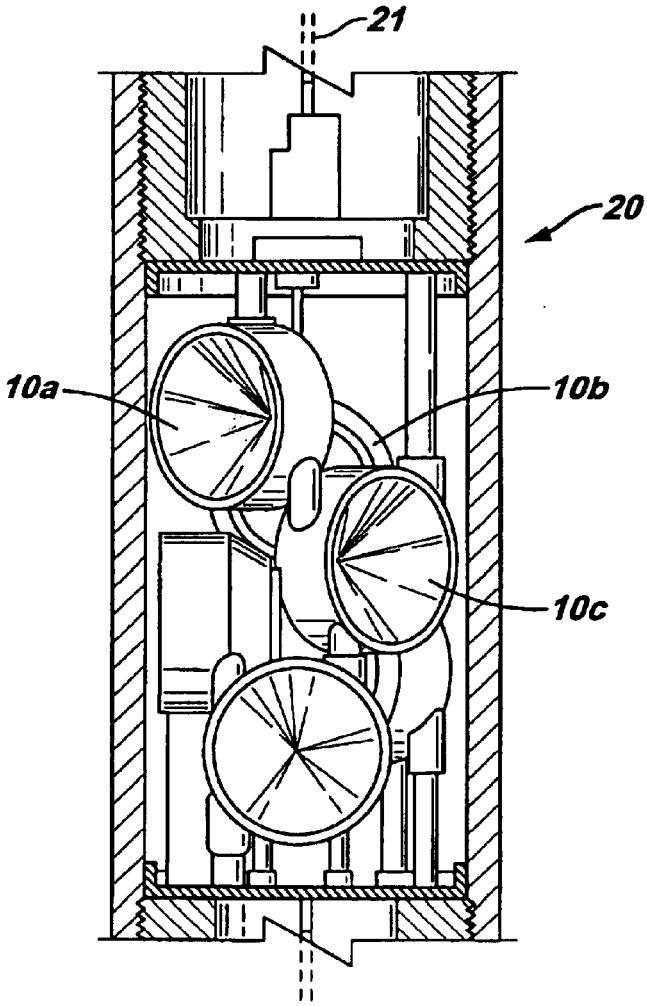
FIG. 2 (Prior Art)
FIG. 2 depicts a schematic diagram of the gun of FIG. 1 illustrating the spiral phasing of the shaped charges.
Figure 3:
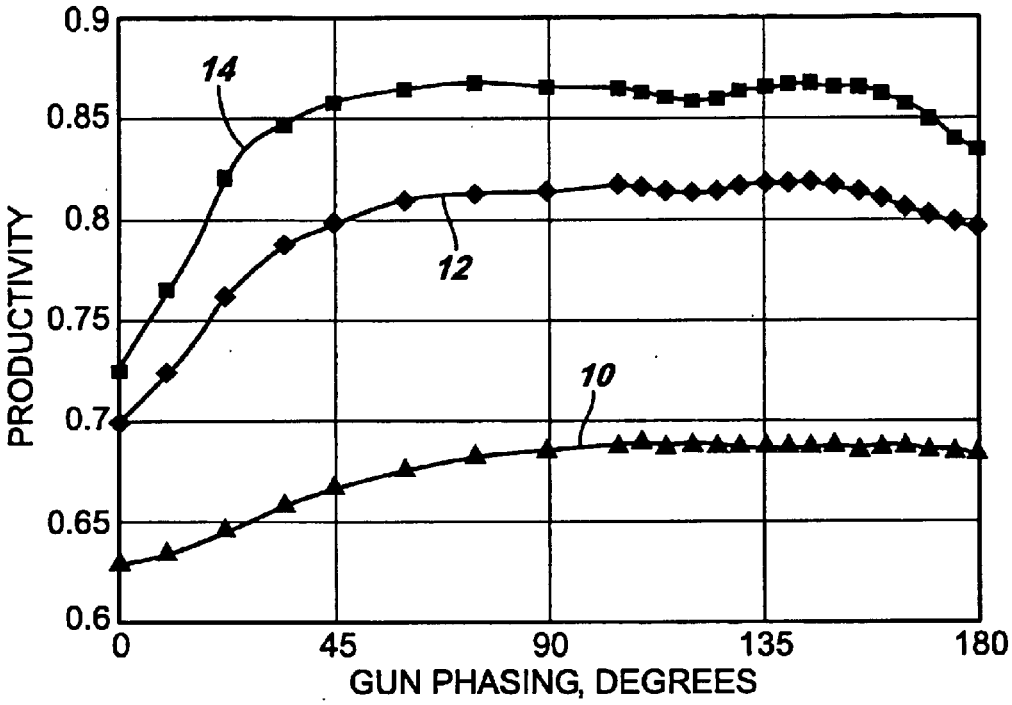
FIG. 3 depicts plots of productivity versus a gun phasing angle for a spiral phasing pattern.

The shaped charges of a perforating gun may be arranged in a spiral phasing pattern, and the angle that separates adjacent shaped charges about the longitudinal axis of the gun defines a phasing angle for the gun. Thus, for example, a perforating gun that has shaped charges arranged in a spiral phasing pattern in which adjacent shaped charges are spaced 45° apart about the longitudinal axis of the gun is said to have a 45° spiral phasing. FIG. 3 depicts the effect on well productivity for different phasing angles.

More specifically, FIG. 3 depicts plots of productivity versus phasing angle for a gun that has shaped charges arranged in a spiral phasing pattern. Three sets 10, 12 and 14 of points are shown in FIG. 3, and each set is associated with a different shot density. Each set of points is associated with a different shot density. For example, the points 14 depict productivity versus phasing angle for a perforating gun that has a shot density of six shots per foot (spf); the points 12 represent the productivity versus phasing angle for a lower shot density of four spf; and the points 10 depict the productivity versus phasing angle for an even lower shot density of two spf.

As can be seen from FIG. 3, for a spiral phasing angle between approximately 45° to 150° (except for the productivity near 120°) the productivity remains relatively the same for all phasing angles. Therefore, the well productivity is relatively insensitive to the phasing angle, provided that 1.) the shaped charges of the perforating gun are arranged in a spiral phasing pattern, and 2, the phase angle is within the range from 45° to 150°.

Although a gun having a spiral phasing pattern is depicted and described herein as an example of a perforating gun in accordance with the invention, it is understood that other phasing patterns may be used. For example, in other embodiments of the invention, a gun with a planar phasing pattern may be used. In these embodiments of the invention, the shaped charges are arranged in planes so that multiple shaped charges are present in each plane. However, for purposes of simplifying the following discussion, a spiral phasing pattern is assumed.

The productivities depicted in FIG. 3 assume that the spiral phasing pattern of the shaped charges extends 360° around the longitudinal axis of the perforating gun. However, in a perforating gun in accordance with an embodiment of the invention, the phasing pattern extends only partially around the longitudinal axis of the gun. More specifically, in some embodiments of the invention, the phasing pattern is non-existent over a particular arc around the longitudinal axis called a wedge. Thus, the shaped charges follow a helical or spiral pattern (around the gun) that is interrupted in this wedge so that no shaped charges are present around the arc that defines the wedge. As a more specific example, for a wedge angle of 90° (as an example), the spiral phasing exists for a continuous 270° angle around the longitudinal axis, but is continuously absent for the 90° wedge angle. The use of this wedge angle permits the optimization of productivity for different well conditions, described below.

Figure 4:
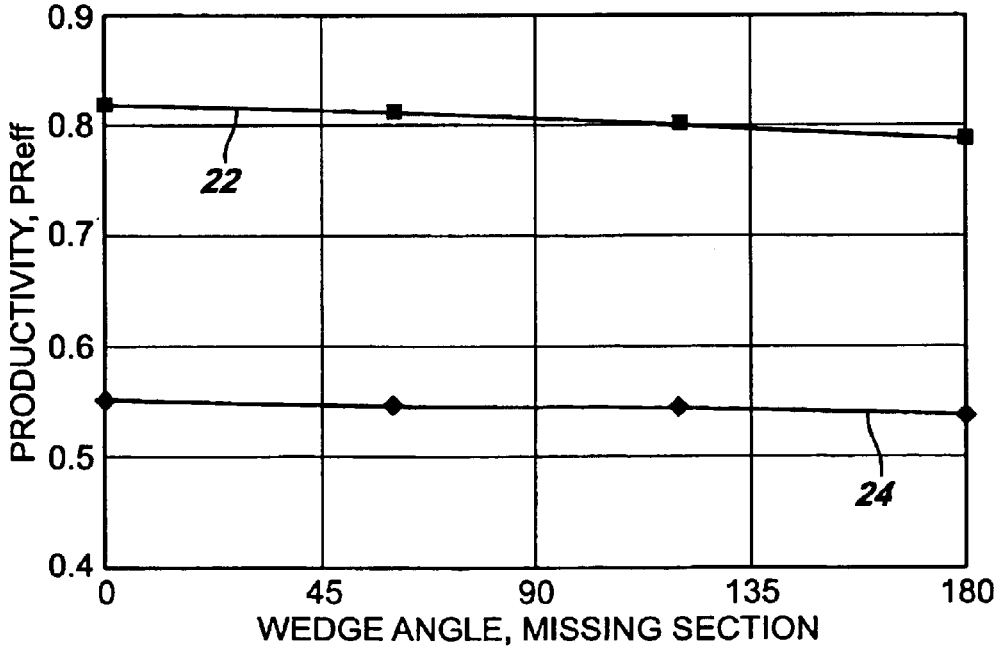
FIG. 4 depicts plots of productivity versus wedge angle.

Referring to FIG. 4, a set of points 22 depicts well productivity versus wedge angle for the case where no perforation damage is present. Spiral phasing is assumed for the wedge. A set of points 24 in FIG. 4 depicts productivity versus wedge angle for the scenario where perforation damage is present. The same shot density is assumed in FIG. 4 for all points. Therefore, the larger the wedge angle, the smaller the spacing between adjacent shaped charges. A wedge angle of 0° means that the spiral phasing pattern is not interrupted and thus extends continuously for 360° about the longitudinal axis of the perforating gun. As can be appreciated from FIG. 4, the well productivity is only slightly reduced with the occurrence of a wedge angle, assuming a constant shot density is maintained.

Figure 5:
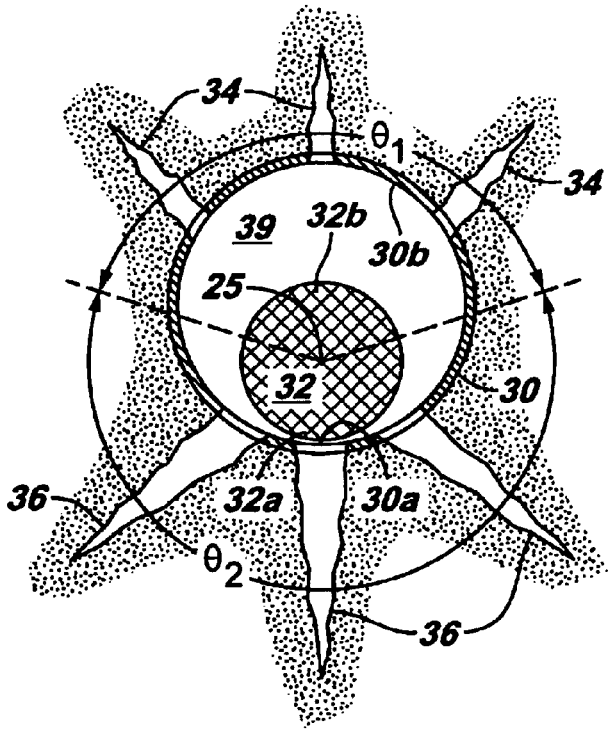
FIG. 5 (Prior Art)
FIG. 5 is cross-sectional view of a well depicting the formation of perforation tunnels by a perforating system of the prior art.

It has been discovered that the quality of the perforations formed by a perforating gun decreases for shots fired across a large water clearance. As a more specific example, FIG. 5 depicts a conventional perforating system (in a cross-sectional view of a well) in which a conventional perforating gun 32 is disposed inside a casing string 30. The perforating gun 32 has shaped charges that are arranged in a phasing pattern (a spiral phasing pattern, for example) that extends 360° about a longitudinal axis 25 of the gun 32. In the context of this application, "spiral phasing" or a "spiral phasing pattern" means that shaped charges of a perforating gun are distributed along a segment of a helix. As shown, the longitudinal axis 25 of the perforating gun 32 is eccentric with respect to the longitudinal axis of the casing string 30. Due to this relationship, a water boundary 39 may exist between the perforating gun 32 and a far (relative to the perforating gun 32) inner surface 30*b* of the casing string 30.

As a more specific example, a portion 32*b* of the perforating gun 32 is defined by an arcuate section that extends through an angle called $\theta_1$ about the longitudinal axis 25 of the perforating gun 32. The shaped charges that are located within the section produce corresponding perforation tunnels 34 in the part of the formation outside of the casing string 30. However, the perforation jets that produce these perforation tunnels 34 must propagate across the water boundary 39 toward the far inner surface 30*b* (also defined by the $\theta_1$ angle) of the casing string 30. In contrast to these shaped charges, the other shaped charges of the perforating gun 32 are arranged within another arcuate section that is defined by an angle called $\theta_2$ about the longitudinal axis 25 of the perforating gun 32. This arcuate section defines the portion of the perforating gun 30 closest to the casing string wall. In this manner, a portion 32*a* of the perforation gun 32 extends through the $\theta_2$ angle and is the closest part of the gun 32 to an inner surface 30*a* of the casing string 30. Thus, the shaped charges that are located within the section that is defined by the $\theta_2$ angle produce perforation jets that travel through a significantly less or nonexistent water barrier to produce corresponding perforation tunnels 36.

Figure 6:
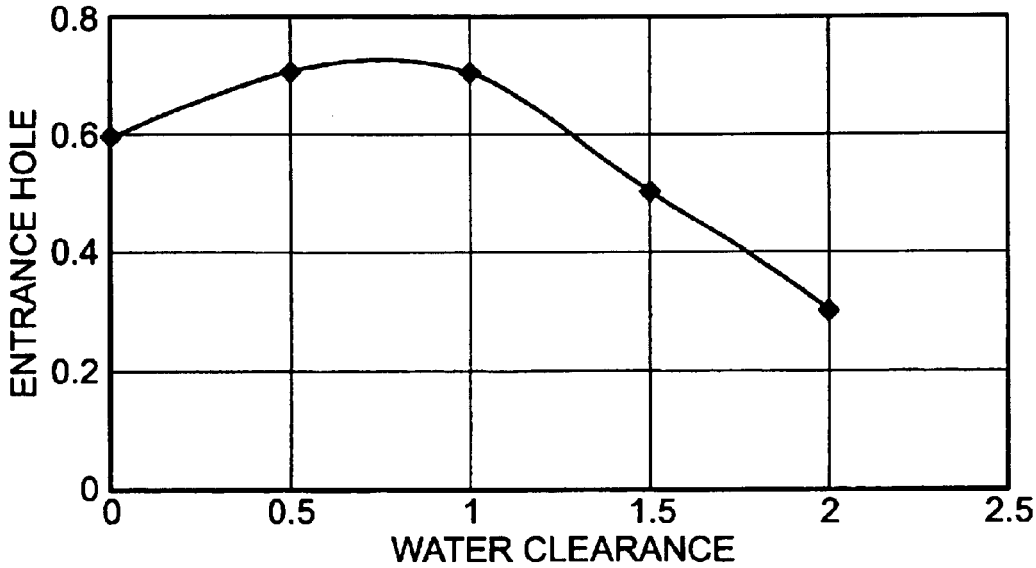
FIG. 6 is a plot of a cross-sectional diameter of the entrance of a perforation tunnel versus a water clearance between a shaped charge that forms the tunnel and the entrance.

The productivity from the perforation tunnels 36 may be significantly greater than the productivity from the perforation tunnels 34 due to the relative sizes of the entrance holes and possibly the relative penetration depths of the perforation tunnels 36. In this manner, productivity is generally a function of the cross-sectional diameters of the entrance holes of the perforation tunnels, and in general, perforation jets that propagate across water boundaries produce perforation tunnels having small cross-sectional entrance hole diameters than perforation jets that propagate across smaller or non-existent water boundaries. This relationship is illustrated in FIG. 6, a figure that shows a plot of the cross-sectional diameter of an entrance hole of a perforation tunnel versus water clearance for the corresponding shot. As shown in FIG. 6, in general, the larger the water clearance, the smaller the entrance hole diameter. Therefore, a shaped charge produces a less productive perforation tunnel if a significant water clearance exists between the shaped charge and the formation.

To overcome the challenges presented by the conventional perforating system depicted in FIG. 5, a perforating gun in accordance with the invention has a phasing pattern that reduces or at least reduces the number of cross-casing shots while maintaining a desired shot density. Such a phasing pattern may be used to increase the average entrance hole diameter and produce more uniform entrance hole diameters, i.e., decrease the standard deviation between the entrance hole diameters. It has been discovered that in a well in which proppant is introduced (in a fracture job), a uniform entrance hole size among the perforations minimizes proppant flow back. Thus, the perforating guns and techniques described herein may be used for purposes of minimizing proppant flow back. As depicted in FIG. 5, the reduction of cross-casing shots is accomplished by interrupting the phasing pattern of the perforating gun by a wedge that is oriented toward the water boundary. The slight reduction in productivity that is suffered by having an arc-sector phasing is more than offset by the increased flow because of an overall increase in penetration and entrance hole size.

Figure 7:
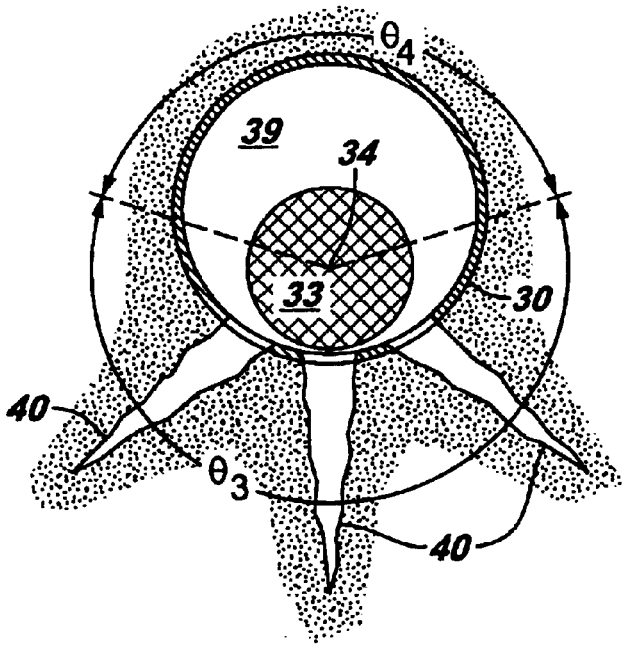
FIGS. 7 and 11 are cross-sectional views of wells depicting perforating systems according to different embodiments of the invention.

FIG. 7 depicts one such perforating gun 33 in accordance with the invention. Unlike conventional perforating guns, the perforating gun 33 has perforating charges that are arranged to produce perforation tunnels 40 across a $\theta_3$ perforating angle (about a longitudinal axis 34 of the gun 33) and not across a $\theta_4$ perforating angle (about the longitudinal axis 34) that produces cross-casing shots. In this manner, the distances between the shaped charges of the gun 33 are selected so that the same desired shot density is maintained across the perforating angle $\theta_3$ as if a 360° phasing pattern were used. The $\theta_3$ perforating angle defines an arcuate section that spans across the closest casing wall surface, and the shaped charges are arranged so that no shots occur across a the $\theta_4$ angle that defines an arcuate section, or wedge, that spans a water boundary 39. Although the perforating gun 33 is depicted in FIG. 7 as resting on the well casing string 30, in some embodiments of the inventions, the perforating gun 33 or a string that is connected to the perforating gun 33 may be attached to one or more spacers, or standoffs, to establish some minimum distance between the gun 33 and the casing string 30.

Figure 8:
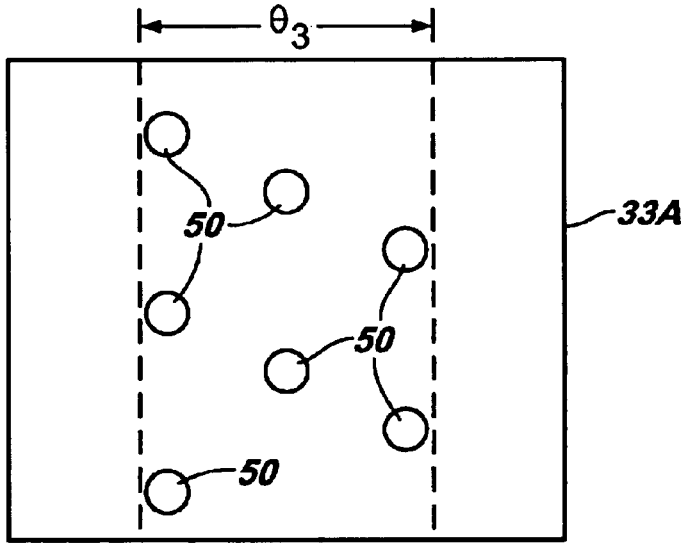
FIGS. 8, 12, 18, 20, 22 and 23 depict shaped charge phasing patterns according to different embodiments of the invention.

To illustrate the orientations of the shaped charges of the perforating gun 33 in some embodiments of the invention, FIG. 8 depicts a phasing pattern of the perforating gun 33. The phasing pattern may be viewed as a flattened section 33A of the perforating gun 33 to illustrate orientations of shaped charges 50 of the perforating gun 33. As shown by the phasing pattern, the shaped charges 50 of the perforating gun 33 are spirally phased over the $\theta_3$ perforating angle, and this phasing pattern has a missing wedge as depicted by the absence of shaped charges 50 in the portion of the section 30A outside of the span of the $\theta_3$ perforating angle. For this example, a spiral phasing pattern is assumed outside of the wedge. However, other phasing patterns outside of the wedge may be used in other embodiments of the invention.

Figure 9:
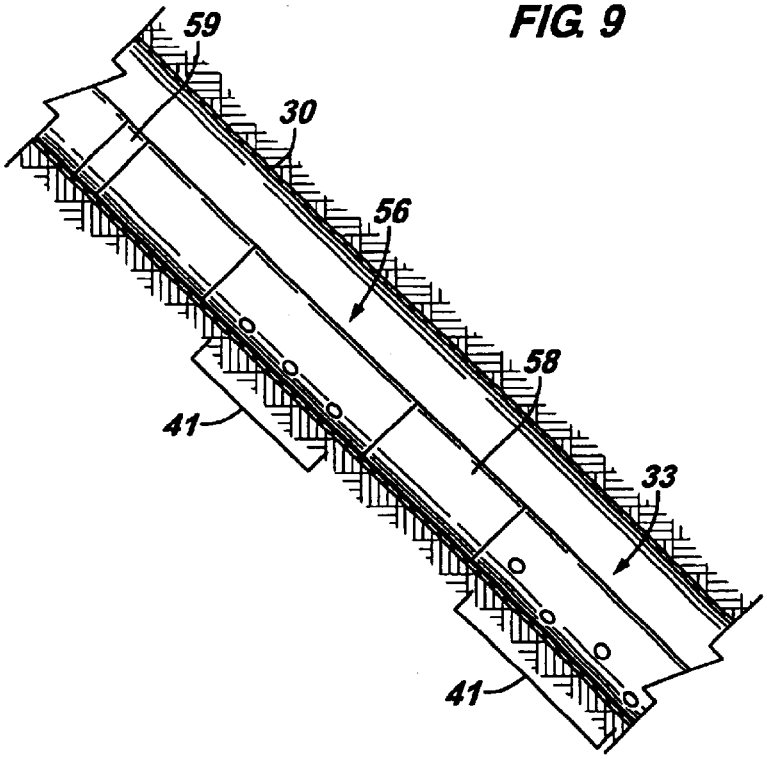
FIG. 9 is a schematic diagram of a perforating system in accordance with an embodiment of the invention.

Referring to FIG. 9, in some embodiments of the invention, the perforating gun 33 may be part of a tubular string 56 that is run into the central passageway of the string 56 for purposes of forming perforation tunnels in a particular zone of the well. Alternatively, the perforating gun 33 may be run downhole via another type of conveyance system, such as a wireline conveyance system (as an example), in some embodiments of the invention.

In some embodiments of the invention, the perforating gun 33 includes an orientation mechanism to orient the perforating gun 33 so that the arcuate section of the perforating gun 33 corresponding to the $\theta_3$ perforating angle is against or at least close to the inner wall of the casing string 30. More specifically, in some embodiments of the invention, this orientation mechanism may be a passive orientation system that responds to gravitational force to orient the perforating gun 33 so that the arcuate section of the perforating gun 33 corresponding to the $\theta_3$ perforation angle is rotated to rest on the bottom interior surface of the casing.

As an example of one such orientation mechanism, the perforating gun 33 may include shaped charge sections 41 that include radially oriented shaped charges directed over the $\theta_3$ perforating angle. Between these sections 41 or alternatively, distributed throughout these sections 41 are eccentering weights 58. A swivel 59 couples the perforating gun 33 to the string 56. In response to the gravitational force on the perforating gun 33, the eccentering weights in combination with the swivel 59 rotate the perforating gun 33 so that the shaped charges of the perforating gun (over the $\theta_3$ perforating angle) are rotated to the rest of the bottom interior surface of the casing string 30. Other orienting mechanisms and orienting techniques may alternatively be used in other embodiments of the invention.

Figure 10:
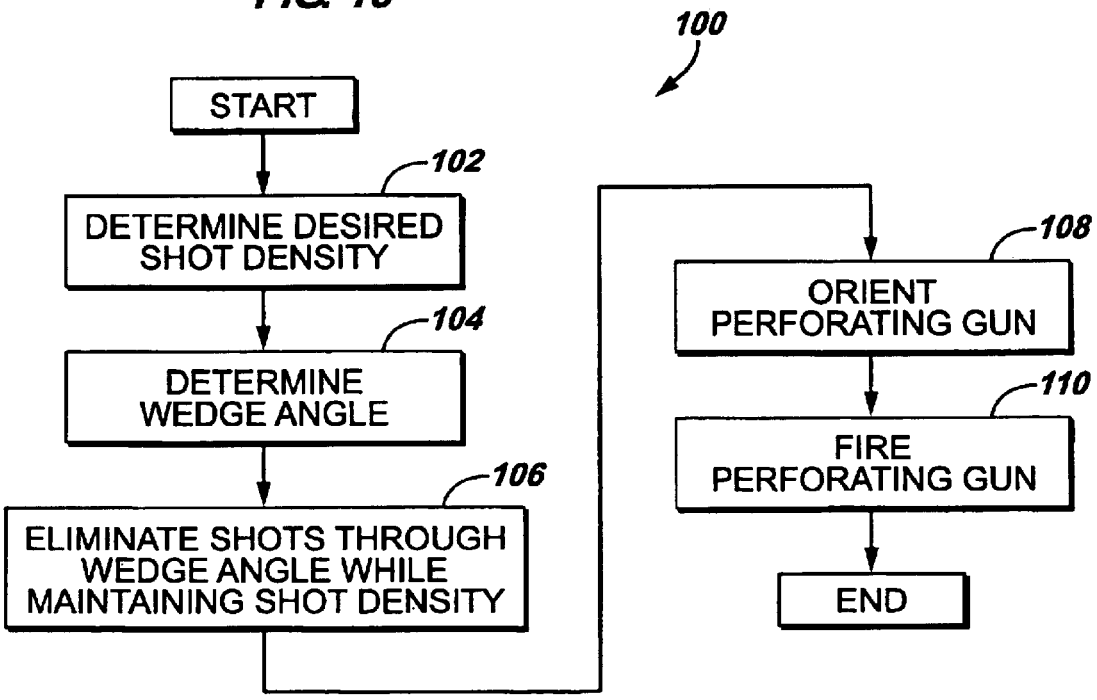
FIGS. 10 and 14 are flow diagrams depicting techniques to orient shaped charges in a perforating gun according to different embodiments of the invention.

To summarize, in some embodiments of the invention, a technique 100 that is depicted in FIG. 10 may be used to reduce or eliminate the number of water boundary perforation shots and as a result, may be used to increase the productivity of the well. In the technique 100, a desired shot density is first determined (block 102). Next, the wedge angle is determined as depicted in block 104. The desired wedge angle may be a function of the casing string diameter, formation characteristics and other various factors, in some embodiments of the invention. With the desired shot density and wedge angle determined, a phasing pattern is chosen and the shaped charges are oriented within this pattern so that perforation shots though the wedge angle are eliminated while the shot density is maintained, as depicted in block 106. The technique 100 also includes orienting (block 108) the perforating gun so that the wedge angle is directed across the casing, leaving the shaped charges directed to the nearest casing wall surface (the wall surface against which the perforating gun rests, for example). The technique 100 then includes firing the perforating gun, as depicted in block 110. Thus, due to this technique 100, cross casing shots across a water boundary should be reduced, if not eliminated, for purposes of optimizing productivity.

Besides optimizing the orientations of the shaped charges and perforating gun for purposes of reducing or eliminating the number of large water clearance shots, the shaped charges and perforating gun may be oriented to compensate for the anisotropic permeability of a formation. A formation that has anisotropic permeability means that the permeability of the formation is a function of position, or space, within the formation and is thus, not constant with respect to space (called "isotropic permeability"). As an example of anisotropic permeability, the permeability of the formation may be horizontally-layered, a condition that means that the permeability in horizontal directions is generally greater than the permeability in vertical directions in the formation.

The productivity of a well typically is mathematically modeled assuming an isotropic permeability. It has been discovered that in a horizontal well, the anisotropic permeability may be modeled as a mathematically equivalent isotropic permeability.

In this modeling, the effective penetrations in the vertical direction are increased due to the anisotropy, relative to penetrations in the horizontal direction. Thus, referring to FIG. 11, a perforating gun 150 in accordance with an embodiment of the invention, may be used to form more penetrations in substantially vertical directions in a horizontal well than penetrations formed in substantially horizontal directions to compensate for the anisotropic permeability. Therefore, unlike conventional perforating guns, the perforating gun 150 has shaped charges that are oriented to form perforation tunnels in the vertical directions and form a reduced number or no perforations in the horizontal directions, while maintaining a desired shot density. Due to this arrangement, productivity is increased, as compared to a uniform 360° phasing pattern that has the same shot density.

Figure 15:
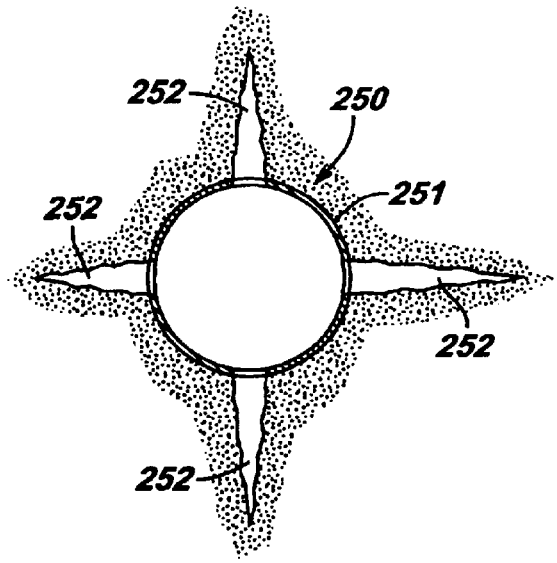
FIG. 15 is a cross-sectional view of a vertical well.

As a more specific example, FIG. 15 depicts a cross-section of the vertical well 250 that has a vertical wellbore 251. As shown, perforations 252 radially extend from the wellbore 251. The vertical well 250 exhibits anisotropy, in that the vertical permeability (kv) is less than the horizontal permittivity (kh). To model this anisotropic well 250 as a mathematically-equivalent isotropic well, the shots per foot ($spf_{Iso.}$) of this equivalent isotropic well may be derived from the following equation:

$$spf_{Iso.} = \frac{spf_{Ans.}}{\sqrt{\frac{kh}{kv}}}, \quad \text{Eq. 1}$$

where "$spf_{Ans.}$" represents the shots per foot of the anisotropic well, "kh" represents the horizontal permeability of the anisotropic well, and "kv" represents the vertical permeability of the anisotropic well. Thus, as can be seen from the equation above, the spf of the isotropic well is less than the spf of the anisotropic well.

Figure 16:
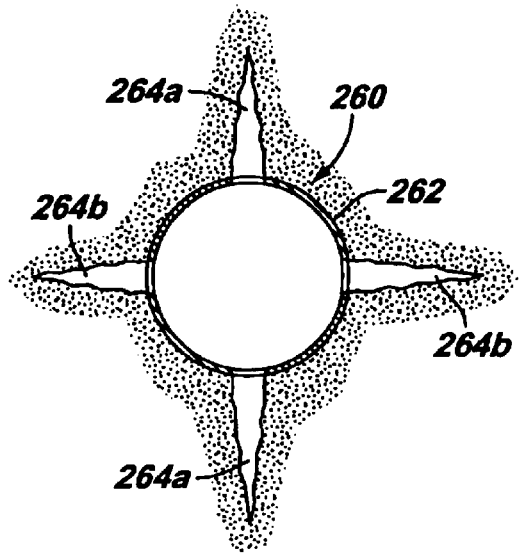
FIG. 16 is a cross-sectional view of anisotropic horizontal well.
Figure 17:
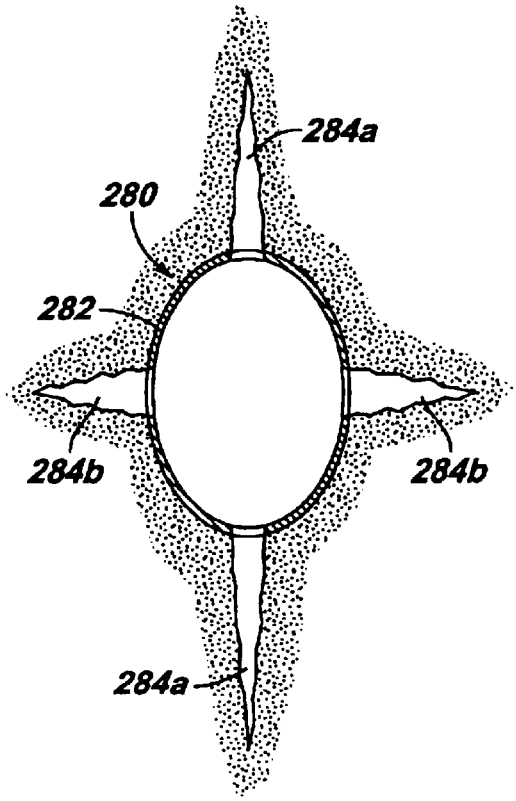
FIG. 17 is a cross-sectional view of an isotropic well that is mathematically equivalent to the anisotropic well of FIG. 16.

FIG. 16 depicts an anisotropic well 260 that includes a horizontal wellbore 262. As shown, the well 260 includes vertically extending perforations 264*a* and horizontally extending perforations 264*b*. In this anisotropic well 260, the vertical permeability (kv) is less than the horizontal permeability (kh). The anisotropic horizontal well 260 may be modeled as a mathematically-equivalent isotropic well 280 that is depicted in FIG. 17.

In this manner, in the well 280, the wellbore 282 becomes elliptical, and the diameter of the perforations are also elliptical. The spf of both the mathematically equivalent isotropic well 280 and the anisotropic well 260 are the same. Furthermore, the lengths of horizontal perforations are the same for both wells 260 and 280. The penetration depth length in the vertical direction is described by the following equation:

$$Pv_{Iso.} = P_{Ans.}\sqrt{\frac{kh}{kv}}, \quad \text{Eq. 2}$$

where "$Pv_{Iso.}$" is the vertical penetration depth in the mathematical equivalent isotropic well, "$P_{Ans.}$" is the uniform penetration depth of the anisotropic well, "kh" is the horizontal permeability, and "kv," is the permeability in the vertical direction. As described by Equation 2 and depicted in FIG. 17, the penetrations are magnified by the difference between the horizontal and vertical permeabilities. Therefore, production may be enhanced by increasing the number of shots in the vertical direction.

Figure 11:
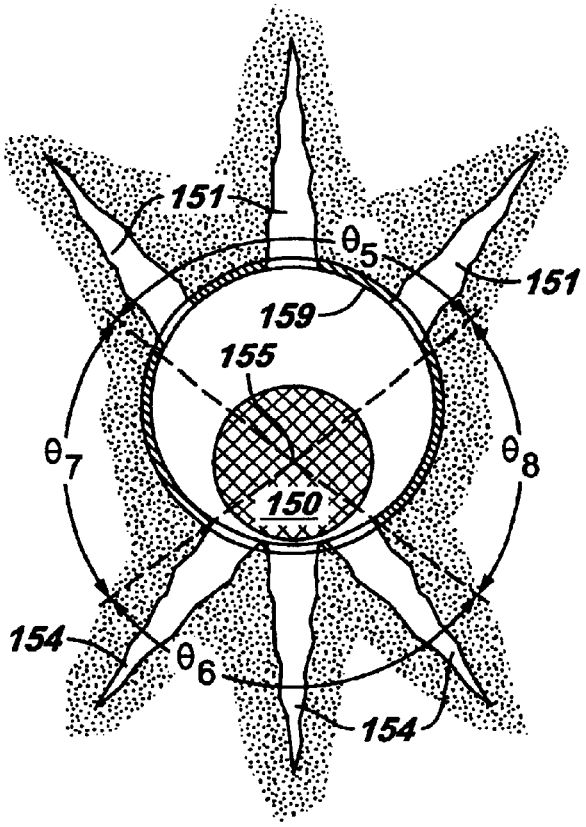

As depicted in FIG. 11, the shaped charges of the perforating gun 150 are oriented to produce generally upwardly directed vertical perforation tunnels 151 over an upper angle $\theta_5$ and produce generally downwardly directed vertical perforation tunnels 154 over an angle $\theta_6$. The perforating gun 150 has no shaped charges that are oriented to produce substantially horizontal perforation tunnels over angles $\theta_7$ and $\theta_8$. The shots from the shaped charges of the perforating gun 150 penetrate the wall of a casing string 159.

It is assumed in this embodiment of the perforating gun 150 that the shaped charges are arranged in spiral phasing pattern having two missing wedges corresponding to the $\theta_7$ and $\theta_8$ angles. However, phasing patterns over than spiral phasing patterns may be used in the perforating gun in other embodiments of the invention.

Figure 12:
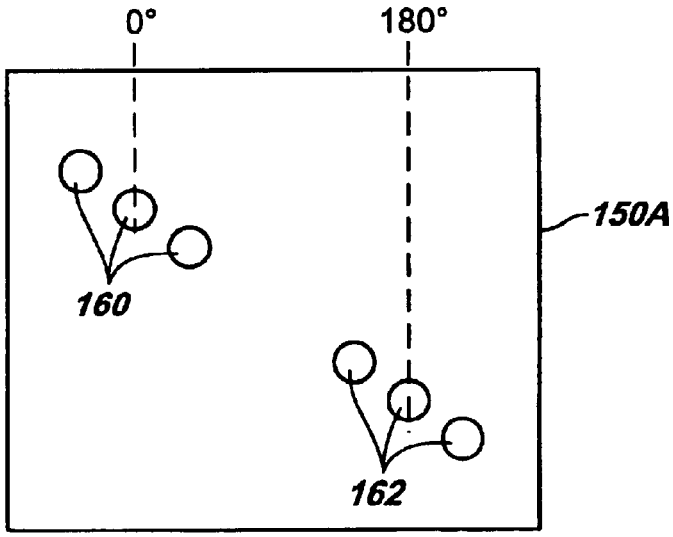

To further illustrate the orientation of the perforating gun 150, FIG. 12 depicts a shaped charge phasing pattern that may be viewed as a flattened portion 150A of the perforating gun 150. As shown, the shaped charges that produced the tunnels 151 produce corresponding perforation holes 160 in the casing section 30B near the 0° (vertical up) direction. The shaped charges that produced the tunnels 154 produced corresponding perforation holes 162 in the casing section 30B near the 180° (vertical down) direction.

For the perforating gun 150 two wedges are removed from the phasing pattern: a first wedge that corresponds to an angle called $\theta_5$ (FIG. 11) and a second wedge that corresponds to an angle called $\theta_6$. Despite the wedges in the phasing pattern, the same shot density is preserved as if no wedges were removed from the phasing pattern. In some embodiments of the invention, the phasing pattern may be spiral phasing pattern. Other phasing patterns may be used.

Figure 13:
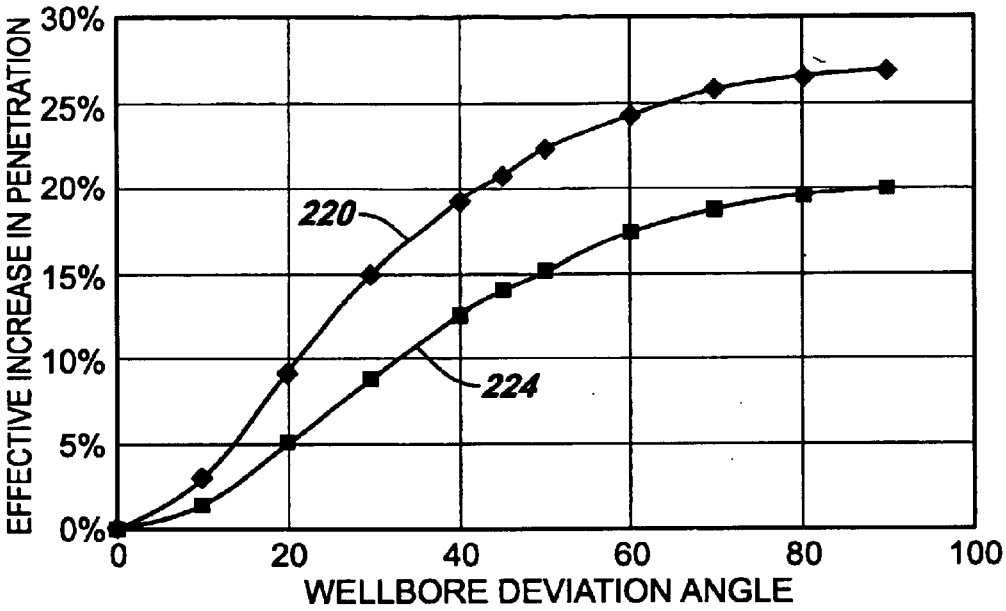
FIG. 13 is a plot of effective increase in penetration versus wellbore deviation angle for the perforating system of FIG. 11.

Although FIG. 11 depicts a horizontal well, the above-described phase optimization to accommodate an anisotropic formation applies also to wellbore deviation angles less than 90° (i.e., the deviation angle of a horizontal well). FIG. 13 depicts the effective isotropic penetrations of the perforating gun 150 when run into a deviated well (having anisotropic permeability) that is not perfectly horizontal. In this manner, FIG. 13 is a plot of the effective increase in penetration with the above-described phasing orientation versus the wellbore deviation angle. As reference, a wellbore deviation angle of zero degrees is a completely vertical well.

FIG. 13 depicts a first set of points 220 for the scenario in which the horizontal permeability of the formation is about ten times the vertical permeability. FIG. 12 also depicts a second set of points 224 for the scenario in which the horizontal permeability of the formation is about five times the vertical permeability. As can be seen, the larger the anisotropy of the permeability, the larger the effective penetration. Furthermore, the closer the wellbore becomes to being horizontal, the larger the effective penetration.

Figure 14:
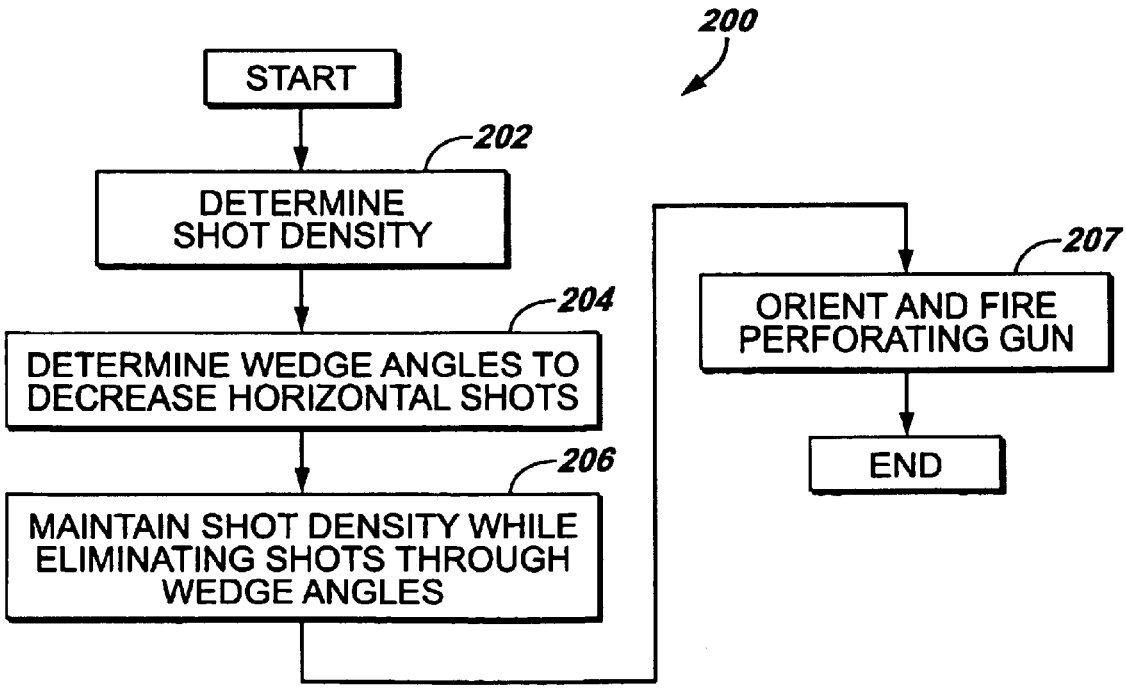

To summarize, in some embodiments of the invention, a technique 200 (FIG. 14) may be used to optimize the permeability in an anistropic formation. This technique 200 includes determining (block 202) the shot density and determining (204) the wedge angles to decrease the number of horizontal shots. While maintaining the shot density, shots through the wedge angles are eliminated, as depicted in block 206, to orient the shaped charges on the perforating gun. Lastly, the perforating gun is oriented and fired (block 207). Similar to the perforating gun 33, the perforating gun 150 may have an orienting mechanism to orient the perforating gun 150 with respect to gravity so that the shaped charges of the perforating gun 150 are oriented primarily in the vertical directions, as depicted in FIG. 11.

Figure 18:
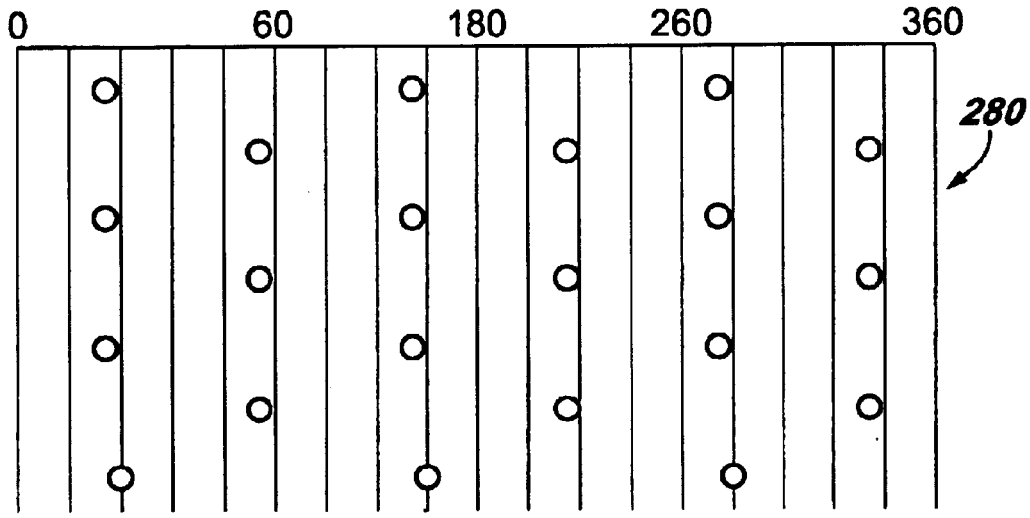
Figure 19:
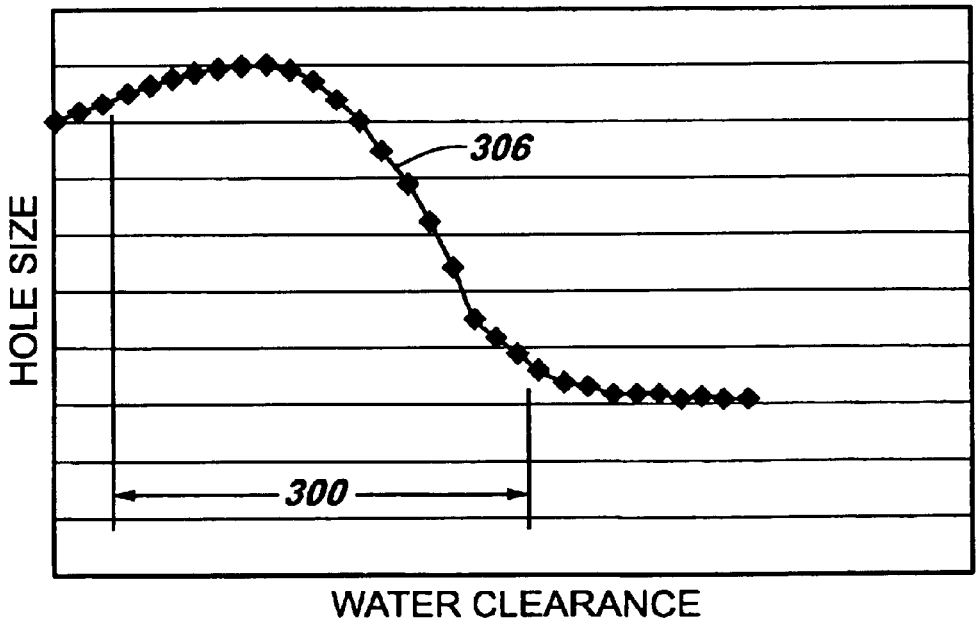
FIG. 19 depicts a plot of hole size versus water clearance for the shaped charge phasing pattern illustrated in FIG. 18.

Other embodiments are within the scope of the following claims. For example, FIG. 18 depicts a conventional gun phasing pattern 280 in which three shaped charges are arranged three in a plane. The shaped charges are located 120° apart and are rotated between planes by 60°. In the example shown in FIG. 18, the spf is 21. FIG. 19 depicts a plot 306 of hole size versus water clearance over a water clearance range 300. This plot will be examined below for purposes of comparing the conventional phasing pattern shown in FIG. 18 with modified phasing patterns described in connection with FIGS. 20 and 22 below.

Figure 20:
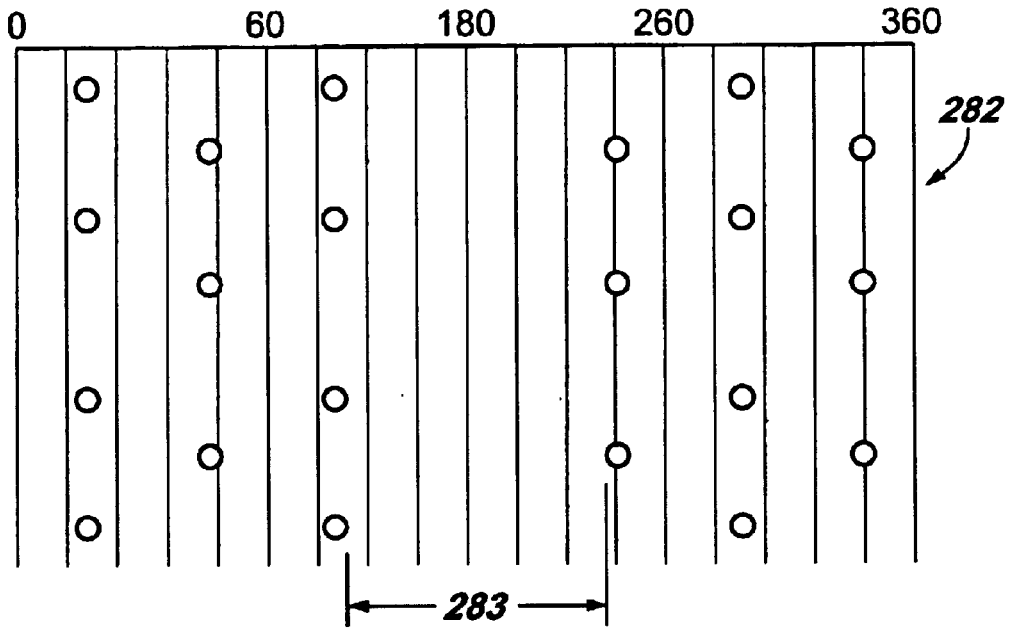
Figure 21:
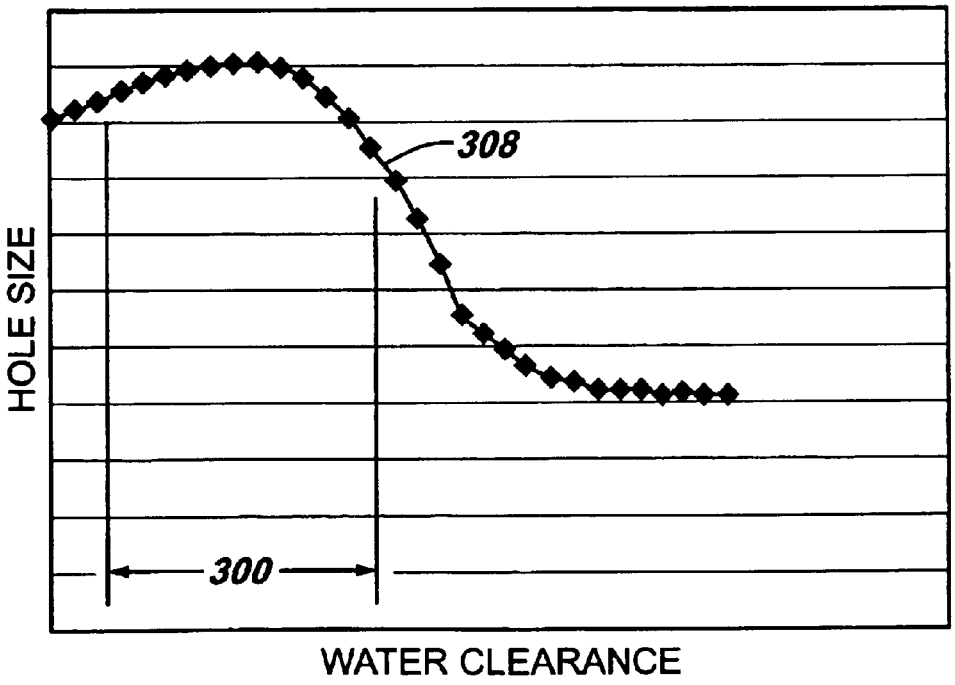
FIG. 21 is a plot of hole size versus water clearance for the shaped charge phasing pattern depicted in FIG. 20.

FIG. 20 depicts a phasing pattern 282 that is modified version of the phasing pattern 280 that is depicted in FIG. 18. The phasing pattern 282 maintains the spf of 21. However, as shown in FIG. 20, an annular wedge 283 of missing shaped charges exists between the 120° and 240° phasing angles to redistribute the shots away from a large water clearance. Each shot plane is rotated by 50°, while maintaining the wedge 283 between 120° and 240°. As depicted in FIG. 21 of a plot 308 of hole size versus water clearance, in the water clearance range 300, the hole sizes are larger, as compared to the corresponding hole sizes depicted in the plot 306 (FIG. 19).

Figure 22:
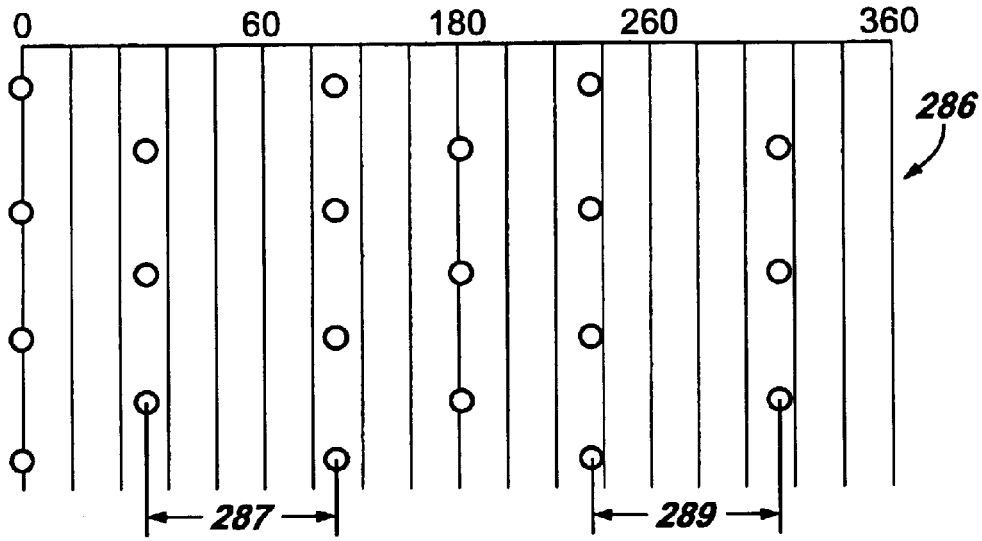

FIG. 22 depicts a phasing pattern 286 that is used in a deviated well with anisotropy. In this manner, the phasing pattern 286 is a variation of the phasing pattern 280 that is depicted in FIG. 18. However, unlike the phasing pattern

Figure 23:
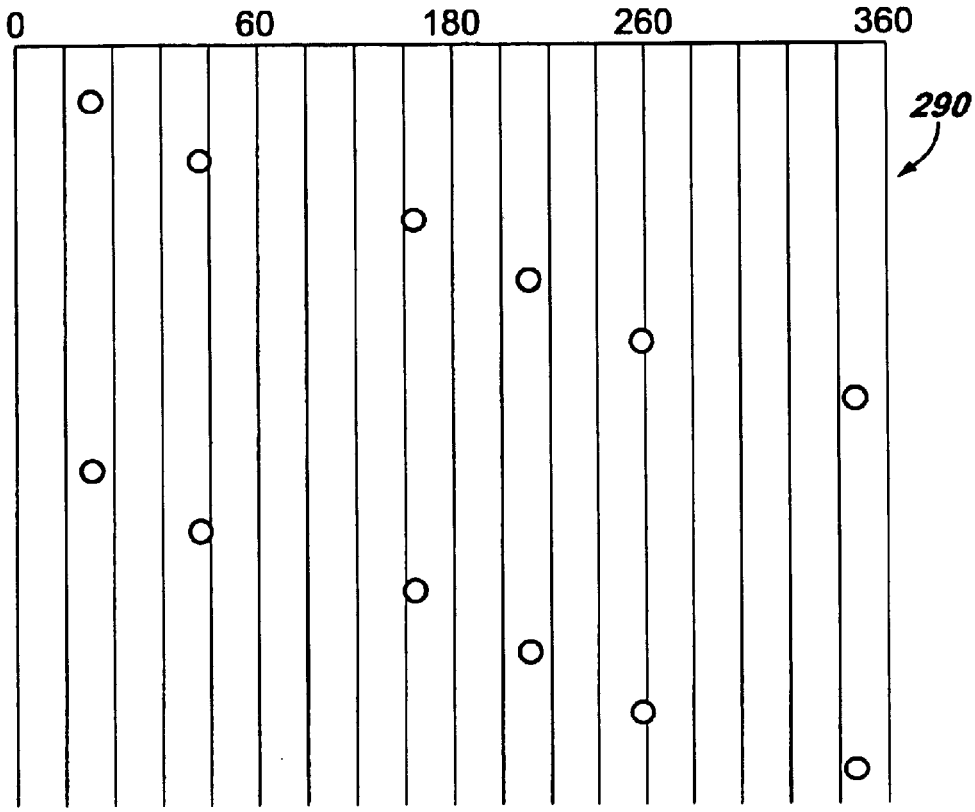

280, shots at wedges 287 and 289 near horizontal positions (i.e., near 90° and 170°) are missing so that shots are distributed away from the horizontal plane. As an example of another variation, FIG. 23 depicts a spiral phasing pattern 290 in which shots are missing in the horizontal planes (i.e., at 90° and 270°). Other variations and phasing patterns are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a subterranean well, comprising:

orienting shaped charges of a perforating gun to extend partially around a longitudinal axis of the gun in a phasing pattern in which the shaped charges are oriented at different angles about a longitudinal axis of the perforating gun;

orienting the perforating gun in the well to direct the shaped charges away from a water boundary; and after orienting the perforating gun, detonating the shaped charges.

2. The method of claim 1, further comprising:

selecting a shot density; and orienting the shaped charges to maintain the shot density.

3. The method of claim 1, wherein the orienting the shaped charges comprises:

orienting the shaped charges in a pattern other than a spiral phasing pattern.

4. The method of claim 1, wherein the orienting the perforating gun comprises:

orienting the perforating gun to increase entrance hole diameters of perforating tunnels formed by the detonations of the shaped charges.

5. The method of claim 4, wherein the orienting the perforating gun comprises:

orienting the perforating gun to produce more uniform entrance hole diameters of perforating tunnels formed by the detonations of the shaped charges.

6. The method of claim 1, wherein the orienting the perforating gun comprises:

orienting the perforating gun to produce more uniform entrance hole diameters of perforating tunnels formed by the detonations of the shaped charges.

7. The method of claim 1, wherein the water boundary comprises water between an inner surface of a casing string and an exterior of the perforating gun.

8. The method of claim 1, wherein:

the perforating gun is inside a casing string, and a longitudinal axis of the perforating gun is eccentric with respect to a longitudinal axis of the casing string.

9. A system usable with a subterranean well, comprising:

a perforating gun comprising shaped charges oriented to extend partially around a longitudinal axis of the gun, the shaped charges extending in a phasing pattern in which the shaped charges are oriented at different angles about a longitudinal axis of the perforating gun; and an orientation mechanism to orient the perforating gun in the well to direct the shaped charges away from a water boundary.

10. The system of claim 9, wherein the shaped charges are oriented to maintain the shot density.

11. The system of claim 9, wherein the shaped charges are oriented in a pattern other than a spiral phasing pattern.

12. The system of claim 9, wherein the orientation of the shaped charges increases entrance hole diameters of perforating tunnels formed by the detonations of the shaped charges.

13. The system of claim 12, wherein the orientation of shaped charges produces more uniform entrance hole diameters of perforating tunnels formed by the detonations of the shaped charges.

14. The system of claim 9, wherein the orientation of shaped charges produces more uniform entrance hole diameters of perforating tunnels formed by the detonations of the shaped charges.

15. The system of claim 9, wherein the water boundary comprises water between an inner surface of a casing string and an exterior of the perforating gun.

16. The system of claim 9, wherein:

the perforating gun is inside a casing string, and a longitudinal axis of the perforating gun is eccentric with respect to a longitudinal axis of the casing string.

17. A method usable with a subterranean well extending through a formation having anisotropic permeability, comprising:

selectively perforating the formation to compensate for the anisotropic permeability, the perforating comprising forming more perforations in a first direction associated with a lower permeability than in a second direction associated with a higher permeability.

18. The method of claim 17, wherein the first direction comprises a vertical direction and the second direction comprises a horizontal direction.

19. The method of claim 17, wherein the perforating comprises:

orienting shaped charges of a perforating gun in response to the anisotropic permeability of the formation to optimize productivity.

20. The method of claim 17, wherein the formation has a lower vertical permeability than a horizontal permeability.

21. The method of claim 17, wherein the perforating comprises:

perforating in substantially a vertical direction in the formation.

22. The method of claim 17, wherein the perforating comprises:

not perforating in substantially a horizontal direction in the formation.

23. The method of claim 17, further comprising:

orientating a perforating gun to compensate for the anisotropic permeability.

24. The method of claim 17, further comprising:

orienting shaped charges to compensate for the anisotropic permeability.

25. A system usable with a subterranean well that extends through a formation having anisotropic permeability, comprising:

a perforating gun having shaped charges oriented to extend partially around a longitudinal axis of the gun; and a mechanical device to orient the perforating gun to selectively perforate the formation to compensate for the anisotropic permeability so that the perforating gun forms more perforations in a first direction associated with a lower permeability than in a second direction associated with a higher permeability.

26. The system of claim 25, wherein the first direction comprises a vertical direction and the second direction comprises a horizontal direction.

27. The system of claim 25, wherein the shaped charges of the perforating gun are oriented to compensate for the anisotropic permeability of the formation.

28. The system of claim 25, wherein the formation has a lower vertical permeability than a horizontal permeability.

29. The system of claim 25, wherein the perforating gun perforates in substantially a vertical direction in the formation.

30. The system of claim 25, wherein the perforating gun does not perforate in substantially a horizontal direction in the formation.

31. A method usable with a subterranean well, comprising:

orienting shaped charges of a perforating gun to extend partially around a longitudinal axis of the gun; and orienting the perforating gun in the well to direct the shaped charges away from a water boundary to minimize proppant flow back.

32. The method of claim 31, further comprising:

selecting a shot density; and orienting the shaped charges to maintain the shot density.

33. The method of claim 31, wherein the orienting the shaped charges comprises:

orienting the shaped charges to have a spiral phasing pattern.

34. The method of claim 31, wherein the orientating the shaped charges comprises:

orienting the shaped charges to have a planar phasing pattern.

35. The method of claim 33, wherein the spiral phasing pattern has a missing arcuate section.

36. The method of claim 31, wherein the orienting the shaped charges comprises:

orienting the shaped charges in a pattern other than a spiral phasing pattern.

37. The method of claim 31, wherein the orienting the perforating gun comprises:

orienting the perforating gun to increase entrance hole diameters of perforating tunnels formed by the detonations of the shaped charges.

38. The method of claim 37, wherein the orienting the perforating gun comprises:

orienting the perforating gun to produce more uniform entrance hole diameters of perforating tunnels formed by the detonations of the shaped charges.

39. The method of claim 31, wherein the orienting the perforating gun comprises:

orienting the perforating gun to produce more uniform entrance hole diameters of perforating tunnels formed by the detonations of the shaped charges.

40. The method of claim 31, wherein the water boundary comprises water between an inner surface of a casing string and an exterior of the perforating gun.

41. The method of claim 31, wherein:

the perforating gun is inside a casing string, and a longitudinal axis of the perforating gun is eccentric with respect to a longitudinal axis of the casing string.

42. A method usable with a subterranean well, comprising:

orienting shaped charges of a perforating gun to extend partially around a longitudinal axis of the gun, including orienting the shaped charges to have a spiral phasing pattern;

orienting the perforating gun in the well to direct the shaped charges away from a water boundary; and after orienting the perforating gun, detonating the shaped charges.

43. The method of claim 42, further comprising:

selecting a shot density; and orienting the shaped charges to maintain the shot density.

44. The method of claim 42, wherein the spiral phasing pattern has a missing arcuate section.

45. The method of claim 42, wherein the orienting the perforating gun comprises:

orienting the perforating gun to increase entrance hole diameters of perforating tunnels formed by the detonations of the shaped charges.

46. A method usable with a subterranean well, comprising:

orienting shaped charges of a perforating gun to extend partially around a longitudinal axis of the gun, including orienting the shaped charges to have a planar phasing pattern;

orienting the perforating gun in the well to direct the shaped charges away from a water boundary; and after orienting the perforating gun, detonating the shaped charges.

47. The method of claim 46, further comprising:

selecting a shot density; and orienting the shaped charges to maintain the shot density.

48. The method of claim 46, wherein the orienting the perforating gun comprises:

orienting the perforating gun to increase entrance hole diameters of perforating tunnels formed by the detonations of the shaped charges.

49. A system usable with a subterranean well, comprising:

a perforating gun comprising shaped charges oriented to extend partially around a longitudinal axis of the gun, the shaped charges being oriented in a spiral phasing pattern; and an orientation mechanism to orient the perforating gun in the well to direct the shaped charges away from a water boundary.

50. The system of claim 49, wherein the shaped charges are oriented to maintain the shot density.

51. The system of claim 49, wherein the spiral phasing pattern has a missing arcuate section.

52. The system of claim 49, wherein:

the perforating gun is inside a casing string, and a longitudinal axis of the perforating gun is eccentric with respect to a longitudinal axis of the casing string.

53. A system usable with a subterranean well, comprising:

a perforating gun comprising shaped charges oriented to extend partially around a longitudinal axis of the gun, the shaped charges being oriented in a planar phasing pattern; and an orientation mechanism to orient the perforating gun in the well to direct the shaped charges away from a water boundary.

54. The system of claim 53, wherein the shaped charges are oriented to maintain the shot density.

55. The system of claim 53, wherein the orientation of the shaped charges increases entrance hole diameters of perforating tunnels formed by the detonations of the shaped charges.

56. The system of claim 53, wherein the water boundary comprises water between an inner surface of a casing string and an exterior of the perforating gun.

* * * * *